US005135368A

United States Patent [19]

Amin et al.

[11] Patent Number: 5,135,368

[45] Date of Patent: Aug. 4, 1992

[54] MULTIPLE STAGE ORBITING RING ROTARY COMPRESSOR

[75] Inventors: Jayendra J. Amin, Union Lake; Guntis V. Strikis, Belleville, both of Mich.; Vipen K. Khetarpal, Sidney, Ohio

[73] Assignee: Ford Motor Company, Dearborn, Mich.

[21] Appl. No.: 699,419

[22] Filed: May 13, 1991

Related U.S. Application Data

[63] Continuation-in-part of Ser. No. 362,636, Jun. 6, 1989, Pat. No. 5,015,161.

[51] Int. Cl.[5] ..... F04C 2/344; F04C 23/00

[52] U.S. Cl. ..... 418/6; 418/11; 418/59; 62/509

[58] Field of Search ..... 418/3, 6, 11, 13, 59

[56] References Cited

U.S. PATENT DOCUMENTS

| | | | |
|---|---|---|---|
| 2,695,597 | 11/1954 | Griffiths | 418/59 |
| 2,965,288 | 12/1960 | Butler | 418/11 X |
| 4,086,042 | 4/1978 | Young . | |
| 4,219,314 | 8/1980 | Haggerty . | |
| 4,452,570 | 6/1984 | Fujisaki et al. . | |
| 4,452,571 | 6/1984 | Koda et al. . | |
| 4,507,064 | 3/1985 | Kocher et al. . | |
| 4,558,993 | 12/1985 | Hori et al. . | |
| 4,624,630 | 11/1986 | Hirahara et al. . | |
| 4,628,963 | 12/1986 | Ishijima et al. . | |
| 4,636,152 | 1/1987 | Kawaguchi et al. . | |
| 4,697,994 | 10/1987 | Ishizawa et al. | 418/13 X |
| 4,780,067 | 10/1988 | Suzuki et al. . | |
| 4,781,549 | 11/1988 | Caillat . | |
| 4,782,569 | 11/1988 | Wood . | |

FOREIGN PATENT DOCUMENTS

| | | | |
|---|---|---|---|
| 3536714 | 4/1986 | Fed. Rep. of Germany | 418/6 |
| 652350 | 3/1979 | U.S.S.R. | 418/6 |
| 914812 | 3/1982 | U.S.S.R. | 418/6 |

*Primary Examiner*—Michael Koczo
*Attorney, Agent, or Firm*—Charles H. Ellerbrock; Clifford L. Sadler

[57] ABSTRACT

A gas compressor includes a housing defining a compression chamber, a crankshaft having an eccentric surface radially offset from the axis of rotation of the crankshaft, an orbiting ring rotatably mounted on the eccentric for rotation about an axis offset from the shaft axis, a cylindrical post coaxial with the axis of the housing passages for carrying gas to and from the compression chamber, vanes movable radially with respect to the orbiting ring, and pressure sensitive valves that open exhaust passages from the compression chamber. The orbiting ring rotates in continual contact with the inner surface of the housing and the outer surface of the cylindrical post. Compression occurs within a first stage space and a second stage space, each space divided into compression chambers by the sliding vanes and contact between the ring and post or between the ring and housing. An intermediate pressure chamber is located in one end of the housing and this chamber can be configured to allow for intercooling of the refrigerant. It is also possible to provide gas separation of the discharge gas and return the separated gas to the intermediate chamber for improved efficiency of the compressor.

12 Claims, 10 Drawing Sheets

MULTIPLE STAGE ORBITING RING ROTARY COMPRESSOR

This application is a continuation-in-part application of U.S. application Ser. No. 07/362,636 filed Jun. 6, 1989, now U.S. Pat. No. 5,015,161.

BACKGROUND OF THE INVENTION

1. Field of the Invention

This invention relates to the field of gas compressors, especially to compressors for air conditioning systems. The invention pertains to gas compressors of the type having orbiting rings or rolling pistons.

2. Description of the Related Art

A conventional rotary compressor is constructed so that a crankshaft having an eccentric part is driven in a cylinder by a motor. A rolling piston fitted to the eccentric part compresses refrigerant gas inducted into the cylinder. A compression chamber is formed inside the cylinder between its axial ends and a vane, which is slidably held by the cylinder and has an end portion contacting the outer surface of the rolling piston. Rotary compressors of this general type are described in U.S. Pat. Nos. 4,219,314; 4,636,152; 4,452,570; 4,452,571; 4,507,064; 4,624,630; and 4,780,067.

A discharge valve for use in a rotary compressor of this type is described in U.S. Pat. No. 4,628,963. The valve includes a leaf spring and a flexible valve plate which opens and closes a discharge port. A vane operating in a rotary compressor is described in U.S. Pat. No. 4,086,042. The vane includes a pivotal shoe joined by a socket connection to the vane. The moving surface of the piston is contacted by the vane shoe.

A technique for modulating the capacity of a rotary compressor is described in U.S. Pat. No. 4,558,993.

A technique for manufacturing a rolling piston rotary compressor is described in U.S. Pat. No. 4,782,569.

A scroll-type gas compressor is described in U.S. Pat. No. 4,781,549. This compressor includes symmetrical scroll members encircling one another in one wrap. The ends of the wrapped members provide continued sealing between the scroll members. The compressor includes a discharge valve that allows a range of pressure ratios to be produced.

SUMMARY OF THE INVENTION

In the near future, a class of air conditioning coolants, hydrofluorocarbons such as R134A, will be used commercially in place of chlorofluorocarbons currently in use. The new coolants operate at substantially higher pressures, perhaps 10–15% higher than conventional coolants, and do not mix as well with lubricating oil as do conventional coolants.

Due to the higher operating pressures required, seals between inlet and compression chambers of gas compressors must be improved. A two stage compressor, such as one of the type of the present invention, has a higher volumetric efficiency than piston compressors. In piston compressors, the suction and compression chambers are adjacent; therefore, they are susceptible to cross flow of coolant from the suction port to discharge port. Also, elevated temperatures of the compression chamber preheat the inlet gas. Preheating the inlet gas reduces the charge or mass of low pressure gas inducted into the compressor, and cross flow reduces exhaust gas pressure. As a consequence of this, the overall efficiency of piston compressors is less than theoretically possible.

Rotary compressors, which operate at higher pressure and slower speeds than piston compressors, are susceptible to loss of overall operating efficiency due to internal leakage resulting from higher compression. Also, high pressure gas is present in the vicinity of an internal seal for a longer period due to the slower speed. The two-stage rotary compressor according to this invention reduces by approximately half the pressure difference across the rotary mechanism and is sealed better than conventional rotary compressors to avoid internal linkage problems.

Rotary compressors of the scroll-type are inherently more complex, and more difficult to machine and to assemble than conventional piston compressors or the rotary compressor according to this invention. In addition, because of the complexity of machining required to produce scroll-type rotary compressors, the cost of fabrication is substantially higher than rotary compressors.

These desirable characteristics are realized and the problems of the prior art avoided with the rotary compressor of the present invention. It includes a housing defining an interior cylindrical space within which multiple stages of compression occur. A cylindrical post is located within the housing concentric with the axis of the housing. An orbiting piston, located between the cylindrical post and the housing wall, is mounted for rotation about an axis that is offset from the axis of the post and interior housing surface so that the outer surface of the orbiting ring contacts the inner surface of the housing and the inner surface of the orbiting ring contacts the outer surface of the post. External vanes, mounted slidably on the housing in a generally radial direction, divide a first space within which the first stage of compression occurs into first and second chambers. Inner vanes, mounted slidably on the post for movement in a generally radial direction, divide a second space where the second stage of compression occurs into third and fourth chambers. Furthermore, as the locations of contact of the orbiting ring with the housing and the post rotate due to the offset axis of the orbiting ring with respect to that of the crankshaft, the first, second, third and fourth chambers are divided and dynamically sealed by these rotating points of contact.

Internal porting carries gas at suction pressure from an inlet port through the housing to suction ports, which are opened and closed by the variable position of the external vanes maintained in contact with the outer surface of the orbiting ring. Gas discharged from the first compression stage and the second compression stage is controlled by operation of reed valves mounted on a valve plate at one axial end of the compression chamber. Gas discharged from the first stage is directed through inlet ports to the second stage along cylindrical passages adjacent the internal vanes. Gas discharged from the second stage of compression leaves the second compression chamber under the control of a second set of valves that open and close communication between the third and fourth chambers. The internal and external vanes are formed with pockets adjacent corresponding inlet ports. The positions of the vanes and their pockets change in relation to the inlet ports in accordance with the radially variable position of the orbiting ring. In this way, the vanes open and close the inlet ports in a regulated action that is coordinated with position of the orbiting ring and pressure within the volumes of the first and second compression stages.

BRIEF DESCRIPTION OF THE DRAWINGS

FIG. 8 is a cross section taken at a vertical plane through an assembled compressor according to FIG. 7, with certain elements deleted for the purpose of clarity.

DESCRIPTION OF THE PREFERRED EMBODIMENTS

Figure 1:
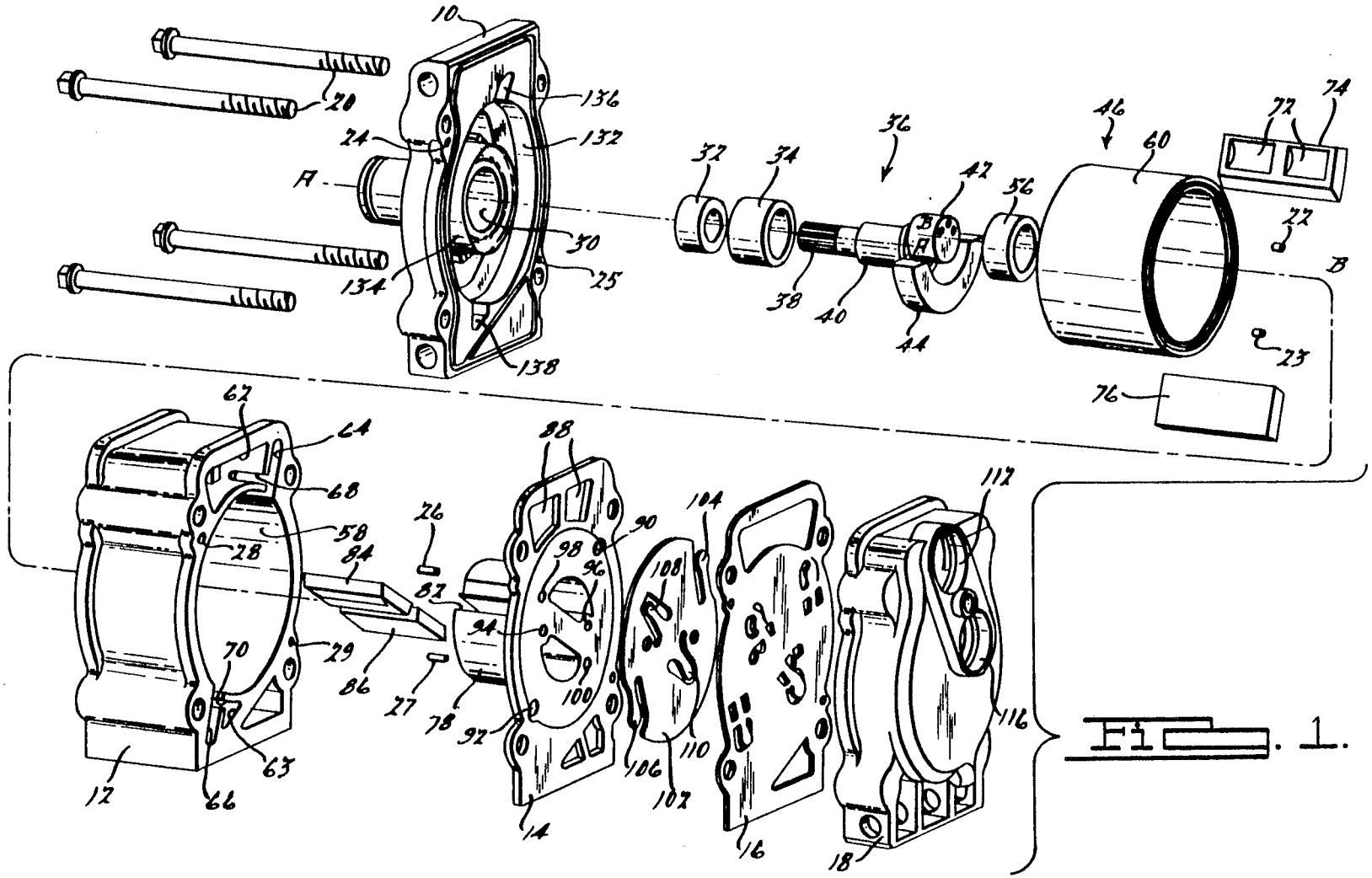
FIG. 1 is an isometric view showing components of the compressor displaced axially from one another and arranged generally in the order of assembly.
Figure 2:
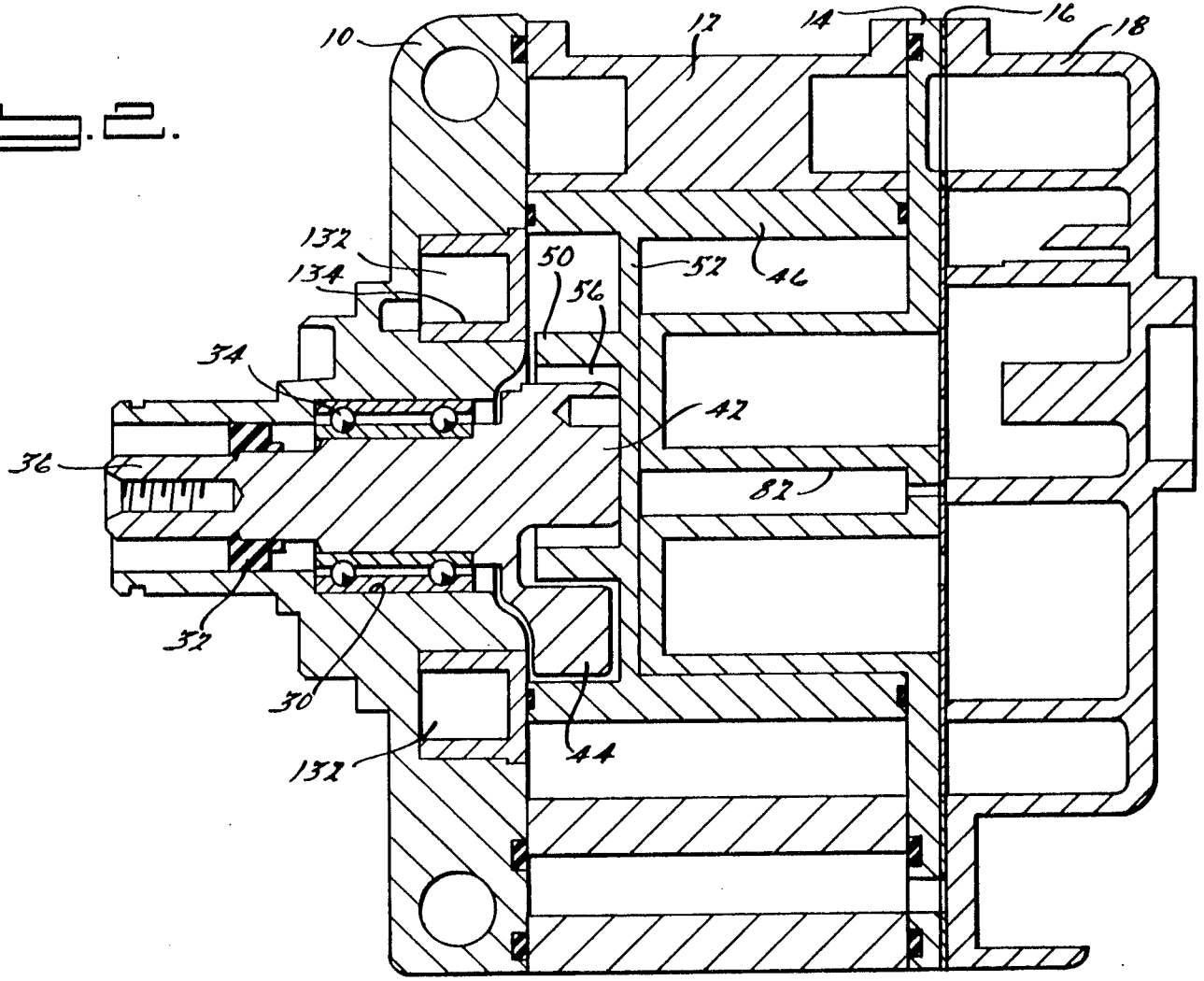
FIG. 2 is a cross section taken at a vertical plane through an assembled compressor with certain elements deleted for the purpose of clarity.

Referring first to FIG. 1, the housing of a gas compressor includes a front head 10, center housing 12, rear gasket 16 and rear head 18. These components and rear plate 14 are mutually connected by passing tension bolts 20 through four aligned bolt holes formed in each of the components and by engaging threads tapped in the rear head. Dowel pins 22, 23 located within alignment holes 24, 25 establish and maintain the angular position of the front head relative to the center housing. Dowel pins 26, 27 located within holes 28, 29 in the rear face of the center housing, the rear plate gasket and front face of the rear head establish and maintain the angular relative position among these components. While dowel pins are described for locating the components relative to one another, other means for locating components are well within the knowledge of one of ordinary skill in the art.

The front head includes a cylindrical bore 30 having a small diameter sized to receive a hydraulic seal 32 and a larger diameter sized to receive roller bearing 34. The bearing rotatably supports a crankshaft 36, which includes a spline surface 38 for drivably connecting the crankshaft to the sheave of a drivebelt assembly, a cylindrical shoulder 40 fitted within the bearing concentric with axis A—A, eccentric 42 having a cylindrical surface whose axis B—B is offset radially from axis A—A, and a large cylindrical surface 44 coaxial with A—A.

Figure 3:
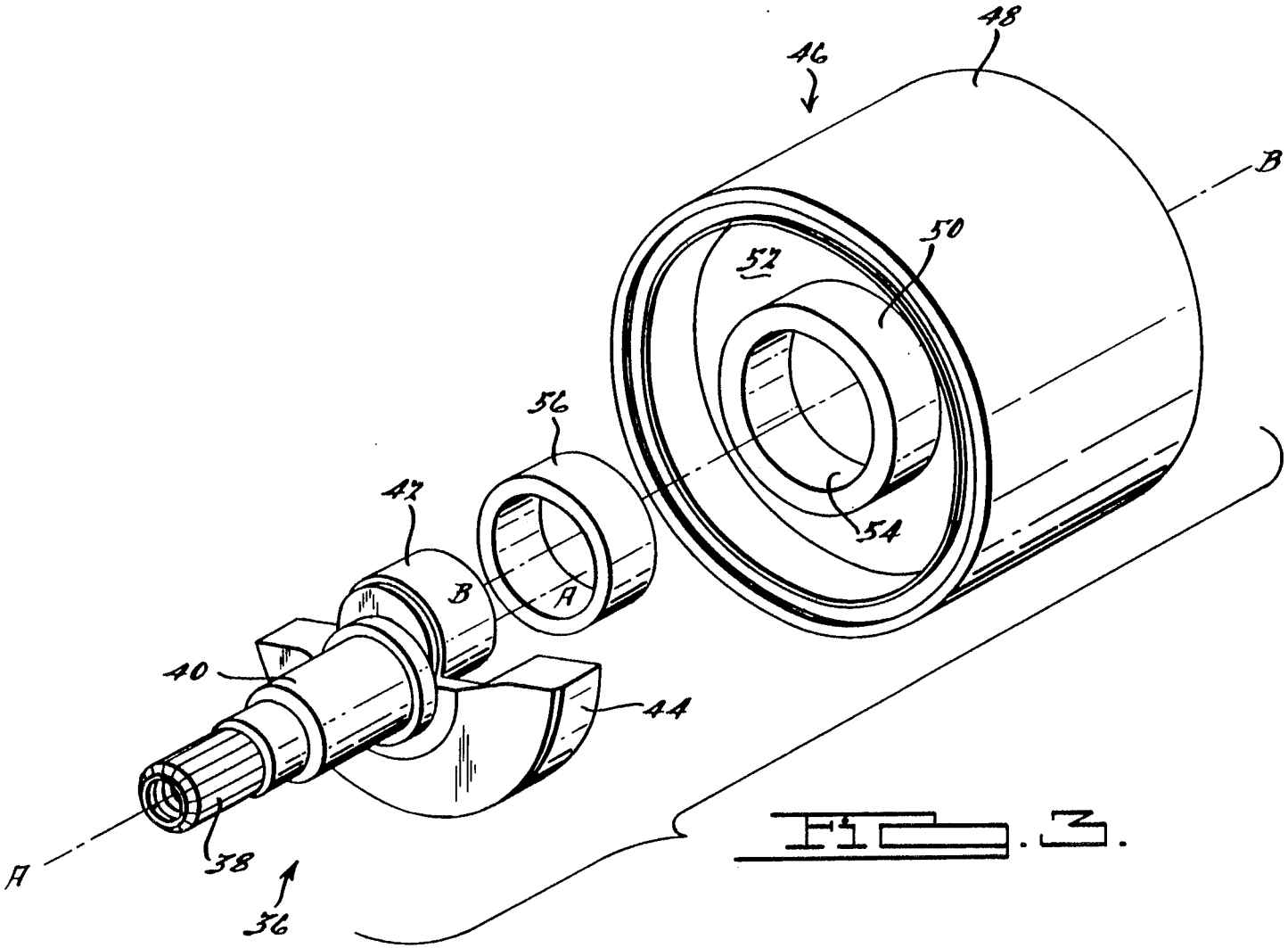
FIG. 3 is an isometric view showing the front face of the orbiting ring, bushing and counterweight.

Referring next to FIG. 3, an orbiting ring 46 includes a cylindrical outer surface 48 coaxial with B—B, a cylindrical boss 50 joined by a web 52 to the outer surface defines a central bore 54 concentric with axis B—B. Bushing 56 is fitted within bore 54 and rotatably supports eccentric 42 on the orbiting ring. Other types of bearings are also possible for rotatably and axially supporting the crankshaft and the orbiting ring.

FIG. 1 shows a center housing 12 that includes a cylindrical inner surface 58 on which the outer cylindrical surface 48 of the orbiting ring rolls, a suction passage 62 through which incoming low pressure gas flows, and outer vane slots 64, 66 in which vanes 74, 76 slide into contact with the outer surface of the orbiting ring. Inlet passages 68, 70, communicating respectively with passages 62, 63, carry refrigerant at suction pressure to inlet pockets 72, 73 formed on the lateral, inner faces of the outer vanes 74, 76, respectively.

Figure 4:
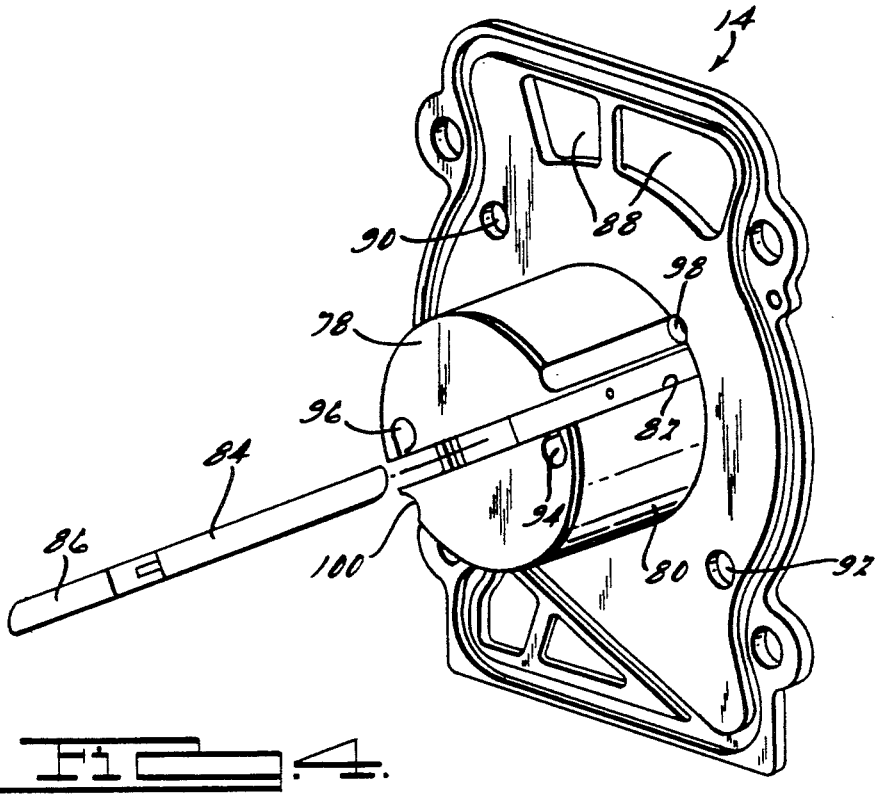
FIG. 4 is an isometric view showing the front face of the center housing.

Referring now to FIGS. 1 and 4, rear plate 14 includes a post 78 having an outer cylindrical surface 80 coaxial with axis A—A, sized to fit within the orbiting ring and located within center housing 12. The post contains a transverse diametric slot 82, within which internal vanes 84, 86 are mounted for sliding radially directed movement into contact with the inner surface of the orbiting ring. The rear plate also includes a suction passage 88 aligned with passage 62, first stage-discharge passages 90, 92, intermediate or second-stage inlet passages 94, 96, and second stage discharge passages 98, 100.

A valve plate 102, formed of spring steel, seats within a circular recess formed on the rear face of head 14 and defines four reed valves: first and second first stage discharge valves 104, 106 for opening and closing passages 90, 92; and first and second stage discharge valves 108, 110 for opening and closing passages 98, 100. The reed valves operate on the basis of pressure difference across the valves to open and close corresponding passages The valves open by bending valve tabs 104, 106, 108, 110 through their thicknesses of the spring steel sheet. As the pressure difference across the valve declines, the degree to which the corresponding passages are opened by the valve decreases due to resilience of the steel sheet and its tendency to close the corresponding passage when the pressure difference is removed.

Located between the adjacent faces of the rear head and rear plate, gasket 16 seals the periphery of the four tension bolt holes, and two dowel holes and the passages opened and closed by the four reed valves, viz. the intermediate pressure passage and inlet or suction passages.

Figure 5:
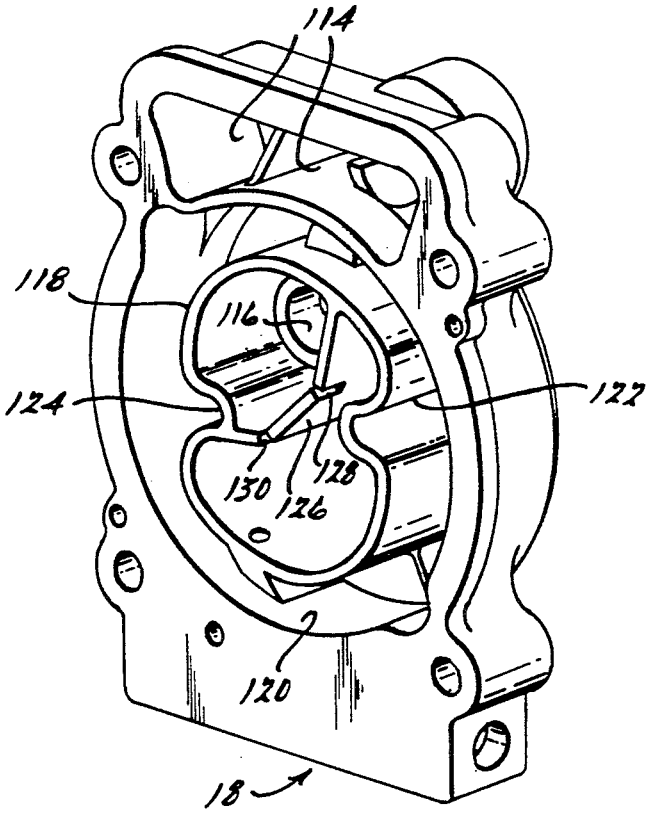
FIG. 5 is an isometric view showing the interior face of the rear head.

Referring next to FIGS. 1 and 5, rear head 18 includes a suction port 112, suction passage 114, aligned and communicating with suction passage 88 and 62, and discharge port 116 communicating with the interior of waisted cylinder 118 integrally cast with the body of the rear head. Surrounding cylinder 118, the walls of the rear head define a space located within the inner surface 120 of the side walls of the rear head. First stage discharge pressure gas flows through passages 122, 124 defined by the waist of cylinder 118. Passages 122, 124 are aligned with intermediate pressure passages 94, 96 formed through the thickness of rear plate 14 and the length of post 78, through which gas compressed in the first stage is carried to and enters the second stage. The volume defined by the walls of cylinder 18 is divided by a baffle 126 defining slots 128, 130. The interior volume of cylinder 118 is divided by the baffle into two portions, each portion communicating with second stage discharge passages 98, 100. The slots in the baffle provide means for passages 98, 100 to maintain communication with discharge port 116 through which gas at discharge pressure leaves the compressor.

The rear face of front head 10 defines an annular passage 132 located between the inner surface of its wall and the outer surface of journal 134, on which the crankshaft is rotatably supported. Passage 132 connects suction passage 136, which communicates with suction passages 62, 88, 114, to first stage inlet passage 138, which communicates with inlet passage 63 formed in the center housing. In this way, suction pressure is continually present in inlet passages 68, 70 and is communicated through the recesses or pockets 72, 73 formed on the surfaces of the outer vanes, through which gas at suction pressure is admitted to the first stage.

Operation of the compressor is described with reference to FIGS. 6A–6H, cross sections through the center housing of an assembled rotary compressor according to this invention. The first stage of compression occurs in a first space bounded by inner surface 58 of the housing and outer surface 48 of the orbiting ring. This space is divided by the outer vanes, which are urged by pressure or spring forces applied to their ends into continuous contact with the orbiting ring, into first and second chambers 152, 154. The location of contact 156 of the ring and housing divides chamber 152 into volumes 142, 146 and divides chamber 154 into volumes 140, 144, whose capacities continually change as the orbiting ring rolls on surface 58 due to its driving engagement with eccentric 42 of the crankshaft.

The second stage of compression occurs in a ring and the cylindrical surface 80 of post 78. The inner vanes, which are urged radially outward against the ring by pressure or spring forces supplied to the post slot between the ends of the vanes, divide this space into third and fourth chambers 160, 162. The location of contact 172 of the ring and post divides chamber 160 into volumes 164, 166 and divides chamber 162 into volumes 168, 170, whose capacities vary continually as the orbiting ring rotates on surface 80.

The first stage of compression is described next beginning with reference to FIGS. 6A. Vane 76 is forced radially outward by contact with the ring so that volume 144 is very small, volume 140 larger, and volume 142 still larger. With the compressor disposed in this way, suction passage 70 is closed by vane 76, volume 142 is open to suction passage 68 and is closed at first stage discharge passage 92 by the action of reed valve 106. Volume 140 may be open to first stage discharge passage 90 subject to control of reed valve 104.

Figure 6A:
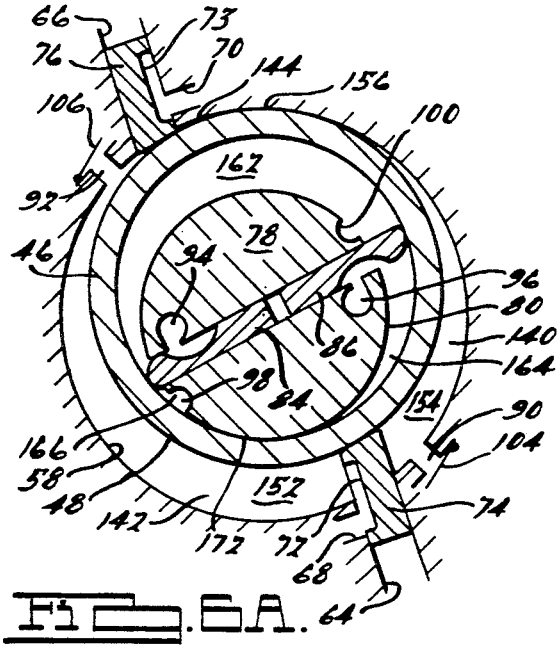
FIGS. 6A–6H show operation of vanes, valves and the orbiting ring of the rotary compressor at successive angular positions of the crankshaft.
Figure 6B:
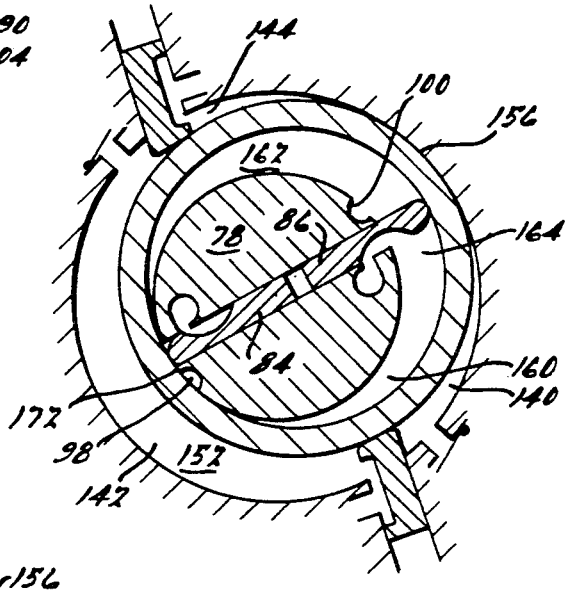

As the orbiting ring moves on surface 58 to the position of FIG. 6B, volume 144 enlarges and vane 76 opens passage 70 to that volume. Pressure rises within volume 140 because its volume decreases due to movement of the ring and contact point 156. Reed valve 104 slowly opens as the pressure within volume 140 rises. Pressure in volume 142 is suction pressure because vane 74 maintains communication with passage 68. The size of this volume increases due to the positional change of the orbiting ring.

Figure 6C:
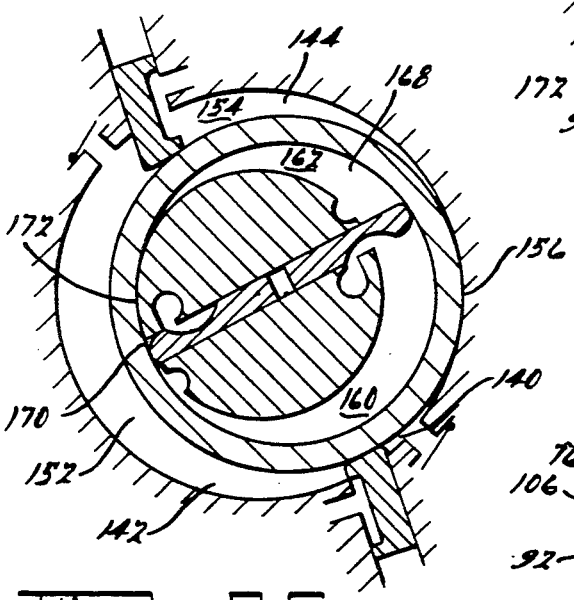
Figure 6D:
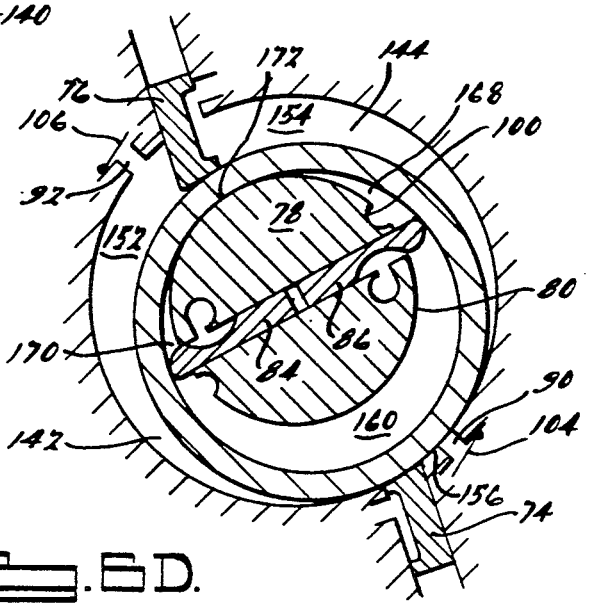

As the orbiting ring and point 156 rotate to the position of FIG. 6C, high pressure gas in volume 140 discharges through passage 90 due to compression occurring there as volume 140 contracts. Compression begins to occur in volume 142 because suction passage 68 closes and volume 142 reduces. Volume 144 expands at discharge pressure due to communication with the suction port through passage 70. When the orbiting ring rotates to the position shown in FIG. 6D, volume 140 becomes nearly zero and its contents discharge through passage 90 because point 156 is nearly coincident with the location of contact between vane 74 and the orbiting ring. Meanwhile, pressure within volume 142 increases as its volume declines before discharge passage 92 is opened by reed valve 106. Volume 144 continues to expand at suction pressure supplied through passage 70 and the pockets formed on vane 76.

FIGS. 6E–6H show that compression continues in volume 142 as its volume decreases due to movement of point 156, and the ring rotates on the housing surface. Eventually, pressure within volume 142 opens valve 106 and allows compressed gas within volume 142 to discharge through passage 92. When the orbiting ring moves to the position of FIGS. 6H, point 156 is so close to the location of contact of vane 76 and the orbiting ring that volume 142 will have substantially disappeared.

Figure 6E:
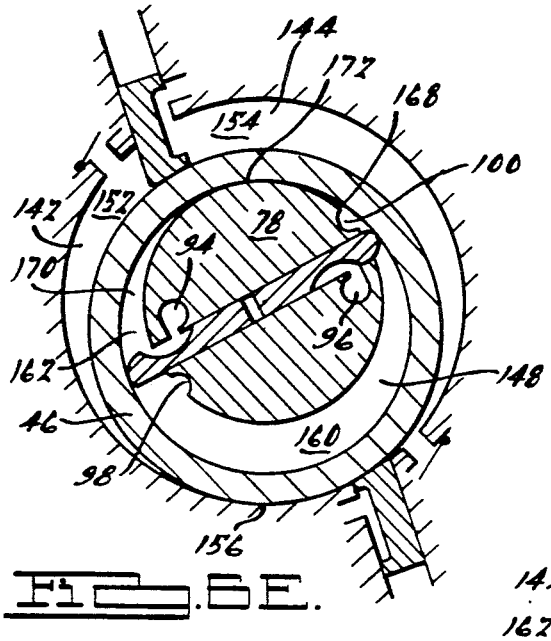

Meanwhile, volume 144 reaches a maximum, suction passage 70 closes (at FIG. 6G), compression occurs in volume 144, and valve 104 eventually opens discharge passage 90. Volume 146 appears first in FIG. 6F where it is shown open to suction passage 68. Its volume continues to expand, as seen in FIGS. 6G and 6H while suction port 68 remains open.

Figure 6F:
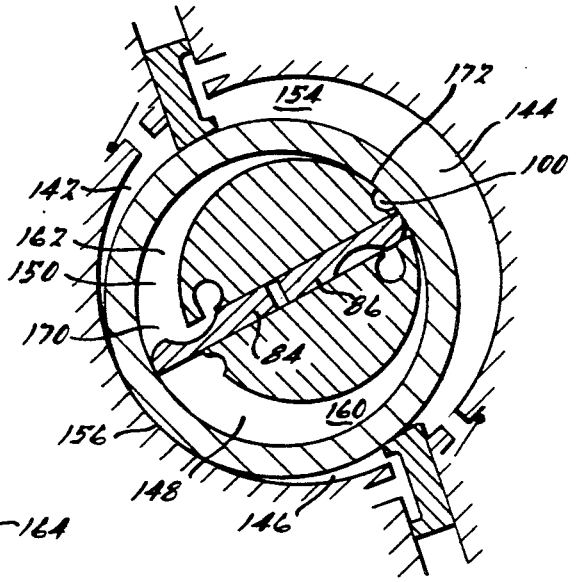
Figure 6G:
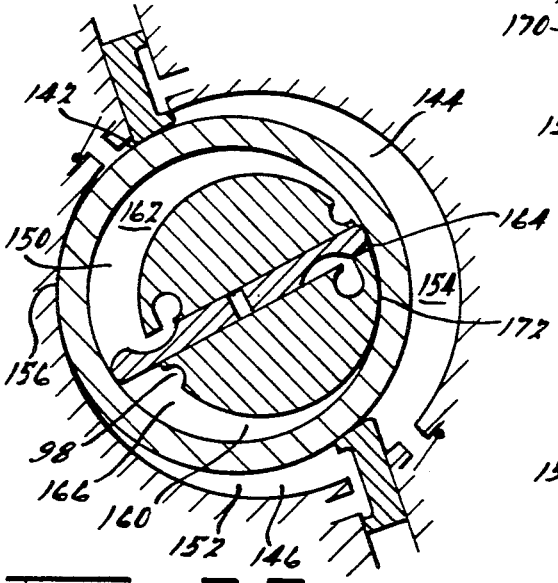
Figure 6H:
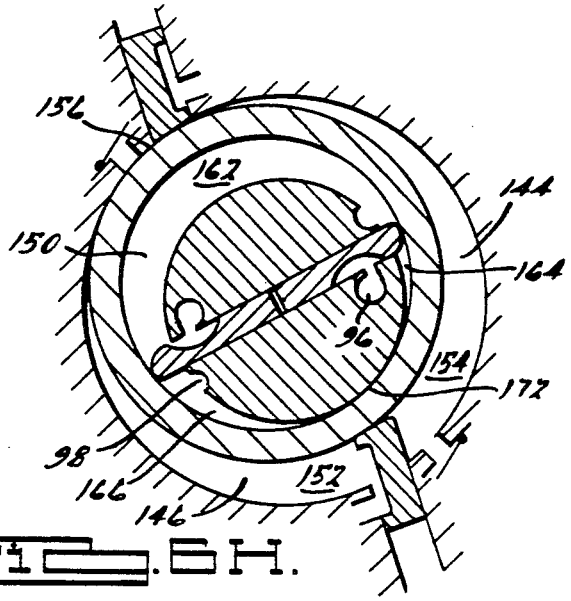

The relative positions of the components of the compressor in FIG. 6H are shown slightly later in the position of FIG. 6A. Notice that volume 146 of FIG. 6H corresponds to volume 142 of FIG. 6A, volume 144 of FIG. 6H corresponds 140 of FIG. 6A and volume 142 of FIG. 6H, which has substantially disappeared in that figure, corresponds to volume 144 of FIG. 6A.

Gas at first stage discharge pressure flows axially along passages 90, 92 through the corresponding reed valves 104, 106 to the space between cylinder 118 and the inner surface of rear housing 18. There the gas flows in the opposite axial direction through intermediate passages 122, 124, intermediate pressure passages 94, 96 of rear plate 14, and pockets on vanes 84, 86, and enters the second space where the second stage of compression occurs.

With the components of the compressor in the position shown in FIG. 6A, chamber 160 is divided into volumes 164, 166 due to contact between the post and the orbiting ring at point 172. Volume 164 contains gas at intermediate pressure because of the open communication with intermediate pressure supply passage 96. Volume 166 contains compressed gas at second state discharge pressure, which causes valve 108 to open passage 98. When the orbiting ring moves to the position of FIG. 6B, point 172 on the post moves substantially to the location of vane 84; therefore, volume 166 decreases to zero and reed valve 108 closes passage 98. Meanwhile, volume 164 continues to expand with gas at intermediate pressure. When contact point 172 passes vane 84, chamber 162 divides into volumes 168 and 170, which progressively decrease and increase, respectively, as the orbiting ring rotates to the position of FIG. 6D. While this occurs, gas in volume 168 compresses to a magnitude that causes valve 110 to deflect and open exhaust passage 100, and the gas pressure in volume 170 goes slightly negative until intermediate passage 94 opens, as shown in FIG. 6E.

As the orbiting ring rotates to the position of FIG. 6F where the point of contact 172 moves closer to vane 86, compressed gas in volume 168 is forced out exhaust passage 100, and volume 170 fills with gas at intermediate pressure. As the orbiting ring rotates from the position of FIG. 6D to that of FIG. 6E, passage 96 closes as vane 86 moves radially inward on post 78, and valve 108 closes exhaust passage 98. Progressive rotation of the orbiting ring causes chamber 160 to contract, thereby compressing the gas in the chamber, and divides the chamber into volumes 164, 166 after contact point 172 passes vane 86.

When the orbiting ring moves to the position of FIG. 6H, gas pressure in volume 164 is slightly negative due to expansion of the volume with port 96 closed. However, as rotation continues to the position of FIG. 6A, passage 96 opens and volume 164 fills with gas at intermediate pressure. Volume 166 contracts, thereby compressing the gas within that space, until the magnitude of the pressure opens vane 108 permitting gas to discharge at second stage discharge pressure.

This process of expansion of the volumes, closure of the inlet passage, compression, and opening of the exhaust passages continues as the cycle repeats and orbiting ring 46 moves again to the position shown in FIG. 6A.

Figure 7:
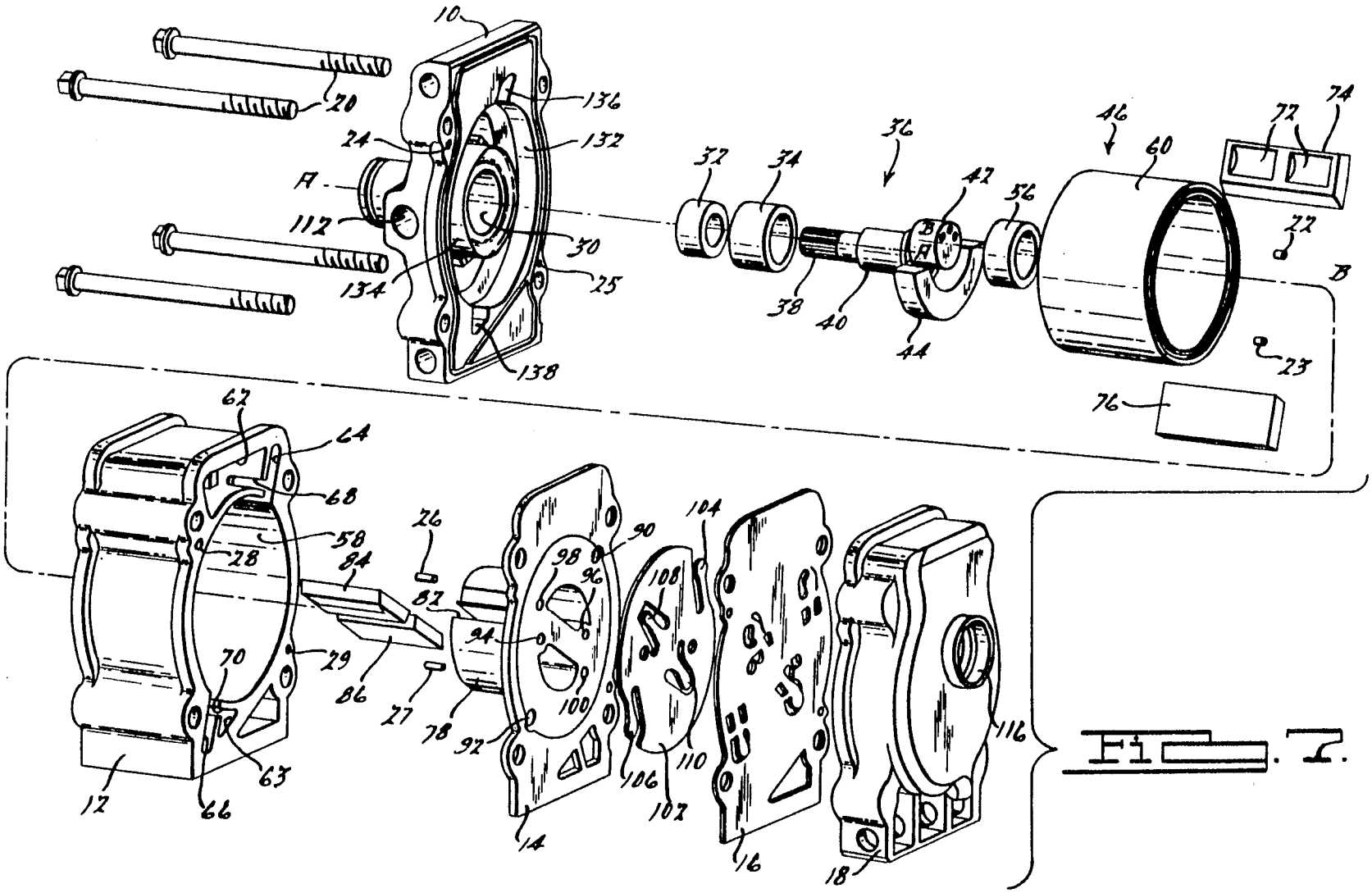
FIG. 7 is an isometric view showing components of another embodiment of the compressor displaced axially from one another and arranged generally in the order of assembly.
Figure 2:
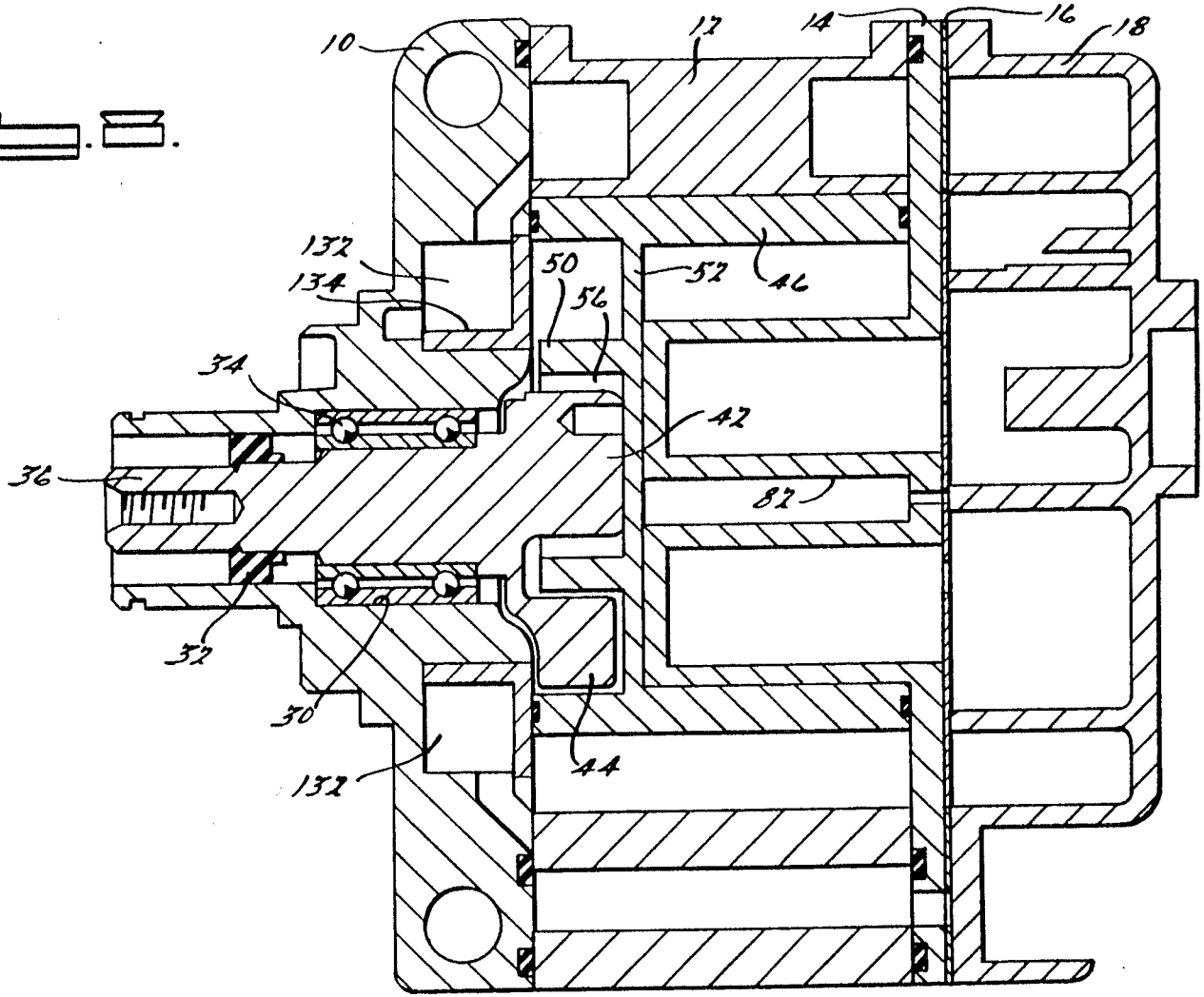

Referring to FIGS. 7 and 8, a second embodiment of the rotary compressor is disclosed. In this embodiment, the reference numerals are the same as those in the first embodiment and the differences between the two embodiments will now be described.

The suction port 112 has been moved from the rear head 18 to the front head 10. This change means that the top opening in the rear gasket 18 and the suction passage 88 are no longer required and thus have been eliminated. It is no longer necessary to pass the refrigerant from the rear head 18 all the way through various components to the outer vanes. Instead, with the suction port 112 on the front head 10, the refrigerant can enter at suction port 112 and feed directly and evenly into passage 132 and from there into volumes 62 and 63. In this way, suction pressure is continually present in inlet passages 68, 70 and is communicated through the recesses or pockets 72, 73 formed on the surfaces of the outer vanes, similar to the first embodiment. This separation of suction and discharge ports substantially prevents heat transfer from occurring between the two different pressure streams.

Figures 9, 11:
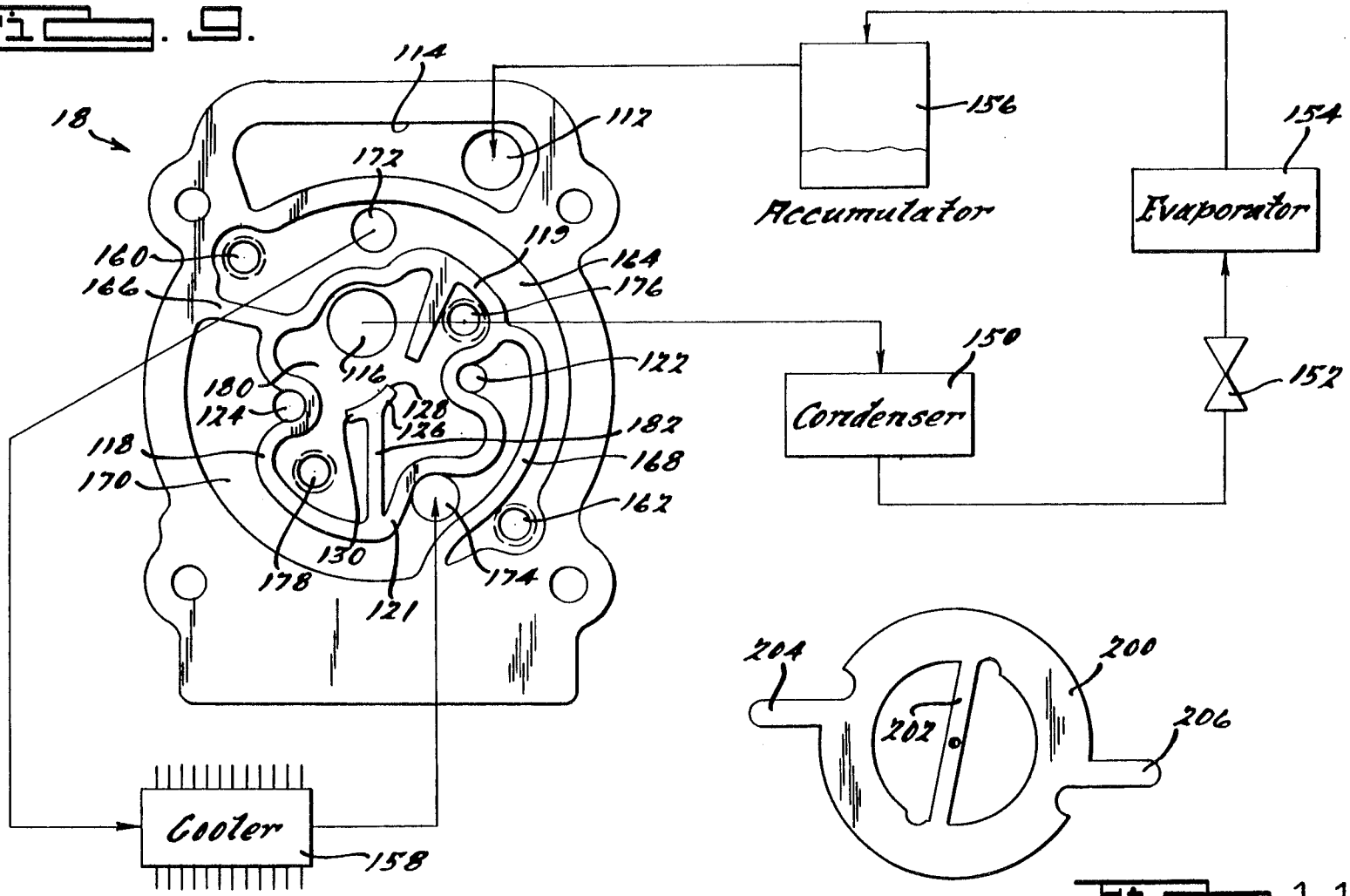
FIG. 9 is a schematic view of the rear housing head and associated components for intercooling according to the present invention.
FIG. 11 is a top view of a wear plate which can be used on the rear plate of the present invention.

FIG. 9 discloses a schematic of an air conditioning system according to another embodiment of the present invention. FIG. 9 shows compressor head 18 and associated components including condenser 150, orifice 152, evaporator 154 and accumulator 156. FIG. 9 also discloses cooler 158 which allows intercooling of the refrigerant gas when it enters an intermediate pressure chamber substantially defined by a cavity in the rear head 18. Intercooling the refrigerant at this point enables the compressor to operate more efficiently.

Figure 10:
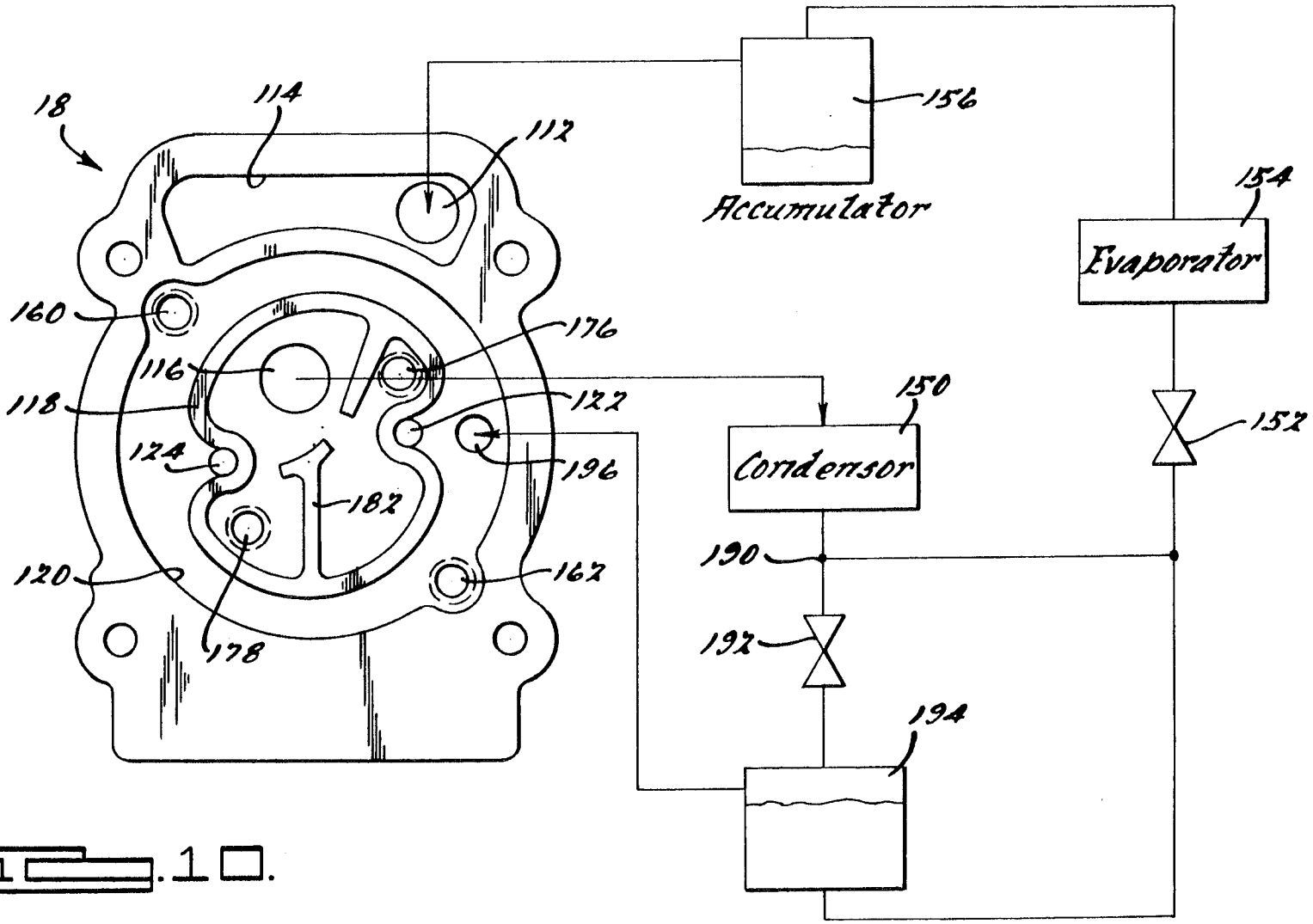
FIG. 10 is a schematic view of the rear housing head and associated components for gas separation according to the present invention.

The schematics of FIGS. 9 and 10 show the suction port 112 disposed in the rear head 18 for the sake of clarity. It should be completely understood that the suction port 112 may be disposed in front head 10 such as is disclosed in FIGS. 7 and 8. In fact, it is preferred for most applications that the suction port be located in the front head.

Operation of the compressor will now be described in connection with FIG. 9. Refrigerant gas is supplied to suction port 112 and into suction passage 114. At this point, the refrigerant is at suction pressure, $P_S$. The gas is then delivered to the first stage compression through the pockets in the outer vanes. Upon compression, the first stage discharge is supplied to the rear head 18 in locations 160 and 162, as has been described above in connection with FIGS. 1–6. Locations 160 and 162 are not ports but do indicate where is defined by the inner surface of the rear head, a first portion 119 of the outer surface of waisted cylinder 118 and walls 166, 168. The walls 166, 168 connect the waisted cylinder 118 to the inner surface 120 of the rear head 18 and separate what was previously one intermediate pressure chamber (as shown in FIGS. 1–6) into two intermediate pressure chambers 164, 170. Cavity 170 is defined by the inner surface of the rear head, a second portion 121 of the outer surface of waisted cylinder 118 and walls 166, 168.

The refrigerant then leaves cavity 164 via port 172 and travels to heat exchanger/cooler 158 whereby the temperature of the intermediate pressure refrigerant is lowered. This procedure may in some instances lower the pressure slightly but that is not critical to proper operation. The heat given off by the refrigerant at this stage may be rejected to the atmosphere or may be utilized for another purpose. Once cooled, the refrigerant is passed back to cavity 170 via port 174. It is contemplated that cooler 158 need not be a separate device from the compressor, in fact, it is possible to place channels in the housing of the compressor where the heat transfer can occur without leaving the compressor.

Upon entering cavity 170,. the refrigerant enters passages 122, 124 whereby it is directed to the second stage inlets through pockets in the inner vanes. Once again, passages 122, 124 are not ports but are shown by circles to indicate the general location where the gas departs the rear head and enters second-stage inlet passages 94, 96. After the refrigerant is compressed in the second-stage and is discharged past the reed valves, it enters cavity 180 in locations 176, 178 and is discharged out discharge port 116 toward condenser 150.

The wall 182 located in chamber 180 is an optional feature and it assists in separating oil from the refrigerant and reduce the gas pulsations before the discharge port.

FIG. 10 discloses another embodiment of the present invention wherein gas separation of the discharge refrigerant is performed to improve compressor efficiency. Once again, the rear head 18 is shown with associated components including condenser 150, orifice 152, evaporator 154 and accumulator 156. In this embodiment, a valve 190, orifice 192 and a gas separator 194 have been added.

Operation of this device is similar to FIGS. 1–6, except that after the refrigerant has passed through condenser 150 it passes through an optional two way valve 190. If valve 190 is positioned in a first position, all refrigerant passes directly to orifice 152 as in a conventional system. If, however, valve 190 is positioned in a second position, refrigerant is then supplied through orifice 192 into gas separator 194. The gas is separated and returned to the compressor through port 196 into the intermediate pressure chamber By proper selection of the pressure drop through the condenser 150, valve 190, orifice 192 and gas separator 194, one of ordinary skill in the art can determine the correct pressure of the refrigerant to be supplied into port 196. This pressure should be slightly higher than the pressure in the first stage so as to prevent back pressure on the gas separator 194. It is also possible to put a check valve between the gas separator 194 and the port 196 to prevent back flow. In this case, the pressure supplied at port 196 can be equal to the rest of the refrigerant in the intermediate pressure chamber. It is also contemplated that refrigerant could, in some cases, be delivered to both orifice 152 and gas separator 194.

While this embodiment is shown with only one intermediate pressure chamber, it is to be understood that two intermediate pressure chambers are possible as shown in FIG. 9. This allows the ability of the compressor to perform both the intercooling functions at the intermediate pressure and the gas separation function. If two intermediate pressure chambers are used, the port 196 would be located in the cavity which also contained the "return from intercooling" port.

FIG. 11 discloses a wear plate 200. This wear plate 200 is preferably made of stainless steel and is disposed on one side of the rear plate 14 such that center portion 202 rests in the groove in post 78. The wear plate 200 is designed so that the inner vanes slide on the center portion 202 and the outer vanes slide on extensions 204 and 206. This plate prevents excessive wear between the vanes and the rear plate 14 and also provides a smooth, continuous surface for the vanes to slide on.

Other changes which are possible include making the center housing and the rear plate integral. This reduces the machining operations and improves manufacturability. It is also contemplated that the rear gasket may be designed so that the valve plate is disposed in a recess in the rear gasket and both the gasket and valve plate surfaces are flush. This eliminates the need for grooving the rear plate and thus improves manufacturability.

The present invention also allows for separation of heat transfer between the refrigerant at lower pressure and the refrigerant at discharge pressure. This can be accomplished by making the gasket and the orbiting ring from heat insulating material. For example, the orbiting ring can be made from a material like phenolic resin which effectively insulates the first stage compression from the second stage.

It is also contemplated to add a thrust bearing (not shown) between the back side of surface near the eccentric and the front cover. This provides for axial support of the shaft and allows clearance between the eccentric and the casting.

It is also not necessary for the device to require two outer vanes or two inner vanes. The device will work if there is only one inner vane and one outer vane.

The present invention has been described with reference to certain preferred embodiments and those skilled in the art, in view of the present disclosure, will appreciate that numerous alternative embodiments of the invention are within the scope of the following claims.

What is claimed is:

1. A rotary compressor comprising:

a housing fixed against rotation, defining an interior surface having a first axis;

a post substantially coaxial with the first axis, located within, and spaced radially from, the interior surface of the housing;

a ring mounted for rotation about an axis radially displaced from the first axis, located within the housing between its interior surface and the post, having a first surface generally spaced from and locally contacting the interior surface of the housing at a first location of contact, and a second surface generally spaced from and locally contacting the post at a second location of contact;

outer vanes contacting the first surface of the ring at angularly spaced locations, dividing a first space bounded by the interior surface of the housing and the first surface of the ring into first and second chambers;

inner vanes contacting the second surface of the ring at angularly spaced locations, dividing a second space bounded by the post and the second surface of the ring into third and fourth chambers;

passage means for carrying fluid to and from the first and second spaces, said passage means including means for carrying fluid from said first space to an intermediate pressure chamber; and valve means for opening and closing communication between the passage means and the first and second spaces.

2. The compressor of claim 1, wherein said intermediate pressure chamber is located in said housing.

3. The compressor of claim 1, said housing further comprising an end portion, said end portion including a cavity disposed therein defining a portion of said intermediate pressure chamber.

4. The compressor of claim 3, wherein said end portion includes refrigerant inlet and outlet ports.

5. The compressor of claim 3, wherein said end portion includes a refrigerant outlet port and said housing includes another end portion which includes an inlet port.

6. The compressor of claim 1, further comprising a wear plate disposed in said housing and adjacent one side of said inner vanes and said outer vanes, whereby said wear plate substantially prevents excessive wear of said inner and outer vanes.

7. The compressor of claim 6, wherein said wear plate is stainless steel.

8. The compressor of claim 1, said housing further comprising:

a front head portion having a refrigerant inlet port therein;

a center housing portion including slots therein for receiving said outer vanes;

a rear plate having said post disposed thereon; and a rear head portion including a refrigerant discharge port therein.

9. The compressor of claim 8, wherein said center housing portion is integral with said rear plate.

10. The compressor of claim 1 wherein the post has a slot directed toward the second surface of the ring;

the housing has angularly spaced slots directed toward the ring;

each outer vane is supported in a housing slot for sliding movement toward and away from the ring; and each inner vane is supported in the post slot for sliding movement toward and away from the ring, and further comprising:

first stage inlet passages opened and closed by movement of the outer vanes in the housing slots; and second stage inlet passages opened and closed by movement of the inner vanes in the post slot.

11. A rotary compressor comprising:

a housing fixed against rotation, defining an interior surface having a first axis;

a post substantially coaxial with the first axis, located within, and spaced radially from, the interior surface of the housing;

a ring mounted for rotation about an axis radially displaced from the first axis, located within the housing between its interior surface and the post, having a first surface generally spaced from and locally contacting the interior surface of the housing at a first location of contact, and a second surface generally spaced from and locally contacting the post at a second location of contact;

an outer vane contacting the first surface of the ring, said outer vane extending into a first space bounded by the interior surface of the housing and the first surface of the ring;

an inner vane contacting the second surface of the ring, said inner vane extending into a second space bounded by the post and the second surface of the ring;

passage means for carrying fluid to and from the first and second spaces, said passage means including means for carrying fluid from said first space to an intermediate pressure chamber; and valve means for opening and closing communication between the passage means and the first and second spaces.

12. The compressor of claim 11, said housing further comprising an end portion, said end portion including a cavity disposed therein defining a portion of said intermediate pressure chamber.

* * * * *